US012714248B1

(12) United States Patent
Kim

(10) Patent No.: US 12,714,248 B1
(45) Date of Patent: Aug. 25, 2026

(54) SOCK REMOVAL DEVICE AND METHOD

(71) Applicant: Christopher Kim, Lake Forest, CA (US)

(72) Inventor: Christopher Kim, Lake Forest, CA (US)

( * ) Notice: Subject to any disclaimer, the term of this patent is extended or adjusted under 35 U.S.C. 154(b) by 0 days.

(21) Appl. No.: 19/335,727

(22) Filed: Sep. 22, 2025

(51) Int. Cl.
*A47G 25/90* (2006.01)

(52) U.S. Cl.
CPC ..... *A47G 25/908* (2013.01)

(58) Field of Classification Search
CPC ..... A47G 25/80; A47G 25/84; A47G 25/86; A47G 25/90; A47G 25/905; A47G 25/908
USPC ..... 223/112
See application file for complete search history.

(56) References Cited

U.S. PATENT DOCUMENTS

| | | | | |
|---|---|---|---|---|
| D275,239 | S | 8/1984 | Raso | |
| 5,050,783 | A | 9/1991 | Hunter | |
| 5,687,889 | A | 11/1997 | Liden | |
| 8,356,735 | B1 * | 1/2013 | Drakeford | A47G 25/905 223/112 |
| 10,463,184 | B2 | 11/2019 | Taylor | |
| 2015/0136816 | A1 | 5/2015 | Aparicio | |
| 2016/0113426 | A1 * | 4/2016 | Showalter | A47G 25/902 223/119 |
| 2024/0188742 | A1 | 6/2024 | Lopez | |

FOREIGN PATENT DOCUMENTS

| | | | | |
|---|---|---|---|---|
| CN | 105125033 A | * | 12/2015 | A47G 25/908 |
| GB | 2539481 | | 6/2015 | |

* cited by examiner

*Primary Examiner* — Nathan E Durham

(57) ABSTRACT

A sock removal device and method for removing socks without touching them includes a heel hook with a first end and a second end defining an opening. A pair of contact members are exposed within the opening. The pair of contact members are spaced from each other by a distance complementary to a size of a heel of a foot wherein the pair of contact members positionable around the heel. Each contact member includes a plurality of frictional elements designed for gripping a sock between the pair of contact members to facilitate the user in removing the sock from the foot. An actuator is selectively movable downwardly relative to the first end. A primary pulley mechanism is mechanically engaged with the actuator wherein downward movement of the actuator actuates the primary pulley mechanism, which actuates a secondary pulley mechanism to urge the pair of contact members toward each other.

16 Claims, 3 Drawing Sheets

SOCK REMOVAL DEVICE AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to undressing aids and more particularly pertains to a new undressing aid for removing socks without touching them.

(2) Description of Related Art Including Information Disclosed Under 37 CFR 1.97 and 1.98

The prior art relates to undressing aids and, more specifically, to sock removers. Sock removers are assistive devices designed to help individuals remove socks without requiring them to bend over, exert significant grip strength, or maintain their balance. These tools are particularly beneficial for users with limited mobility due to back, hip, or knee issues, as well as individuals with reduced hand dexterity resulting from conditions such as arthritis or stroke. Sock removers are also commonly used by individuals who are recovering from surgery, managing obesity, or dealing with balance challenges, such as during pregnancy or advanced age. By enabling users to remove socks independently, these devices promote autonomy and reduce the risk of strain or injury.

Several types of sock removers are commercially available, each suited to different needs and physical limitations. Some dressing sticks feature a specialized notch or hook—often rubber-coated—that allows the user to slide the stick between the sock and the heel, effectively pushing the sock off the foot. These tools are often multipurpose and can also assist with other dressing tasks, though they may require a degree of coordination and may not work well with tight or compressive socks.

Another category includes rigid, ramp-like devices, typically constructed from plastic or metal, which rest on the floor. Users place their heel against the device and slide the foot backward, allowing the sock to be removed through downward pressure and friction. These tools function similarly to boot jacks and are appreciated for their simplicity and ease of use, though they do require placement and stability on the floor surface.

Some modern sock aid systems are dual-function tools that support both the application and removal of socks. These may incorporate grippy surfaces or integrated hooks that catch the sock as the user pulls their foot away. Although such systems are more complex, they offer a comprehensive solution for users who face challenges with both dressing and undressing.

There are also designs that employ a cord or foot loop connected to a textured or friction-enhancing surface that is positioned around the sock. When the user pulls on the cord, the sock is drawn down and removed without requiring them to bend forward. Though less common, these tools offer particular utility for individuals who must undress from a seated or lying-down position.

In some cases, users may resort to improvised solutions such as shoe horns, long-handled spatulas, or rigid household objects to push socks off the foot. While these makeshift tools can be effective in certain circumstances, they often lack the ergonomic and safety features of purpose-built sock removers. The continued need for improved, user-friendly sock removal tools remains evident, especially among aging populations and individuals with disabilities.

BRIEF SUMMARY OF THE INVENTION

An embodiment of the disclosure meets the needs presented above by generally comprising a heel hook with a first end and a second end that defines an opening. A pair of contact members are positioned adjacent to the second end of the heel hook wherein the pair of contact members are exposed within the opening. The pair of contact members are spaced from each other by a distance designed to be complementary to a size of a heel of a foot of a user wherein the pair of contact members are designed for positioning around the heel of the foot of the user. Each contact member of the pair of contact members includes a plurality of frictional elements designed to physically contact a sock on the foot of the user for gripping the sock between the pair of contact members to facilitate the user in removing the sock from the foot.

An actuator is nested within the heel hook and is selectively movable downwardly relative to the first end. A primary pulley mechanism is mechanically engaged with the actuator wherein movement of the actuator downwardly relative to the first end actuates the primary pulley mechanism. A secondary pulley mechanism is mechanically engaged with the primary pulley mechanism and the pair of contact members wherein the primary pulley mechanism actuates the secondary pulley mechanism to selectively urge the pair of contact members toward each other when the actuator is moved downwardly relative to the first end of the heel hook.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
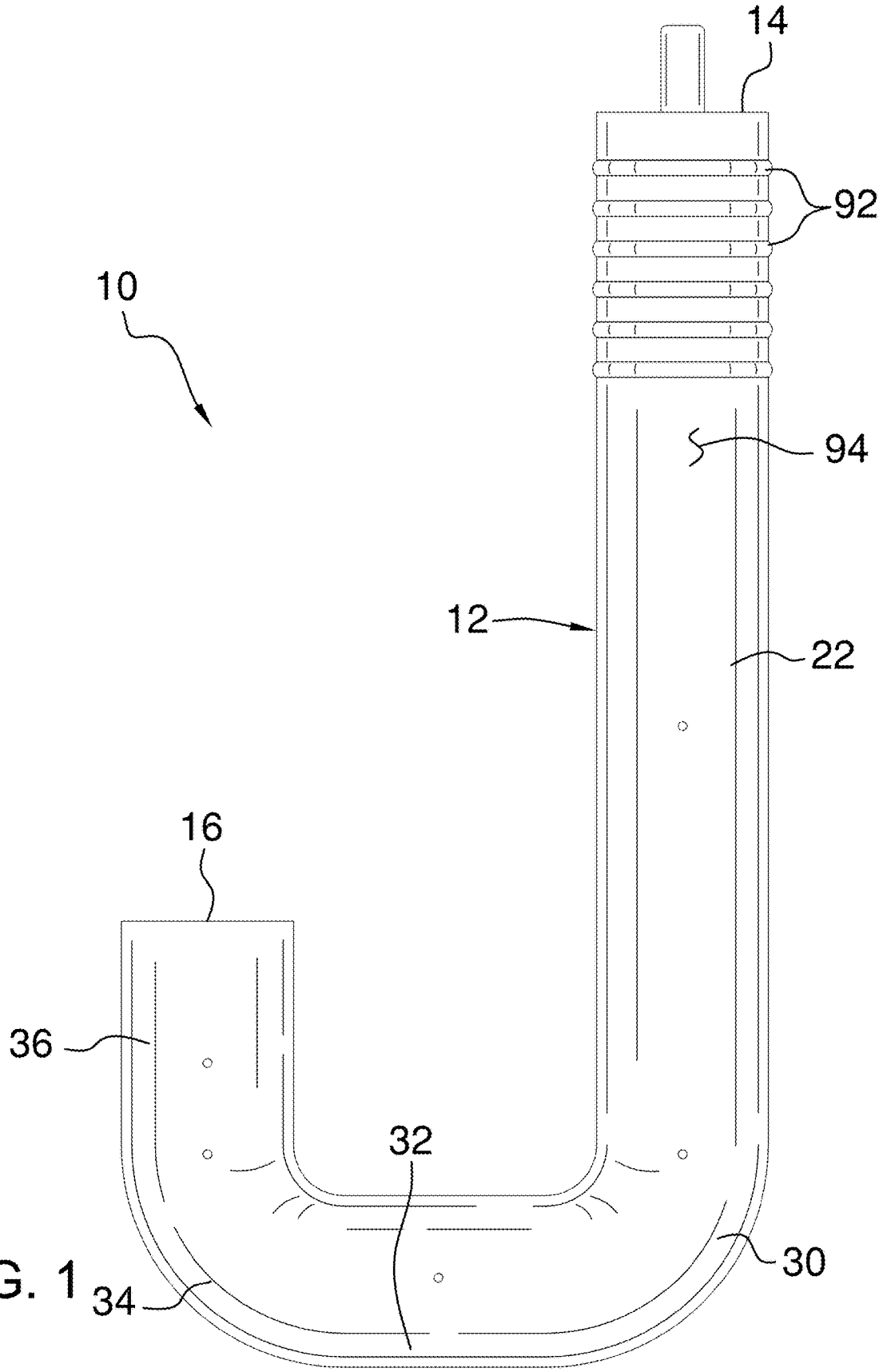
FIG. 1 is a front view of a sock removal device and method according to an embodiment of the disclosure.
Figure 2:
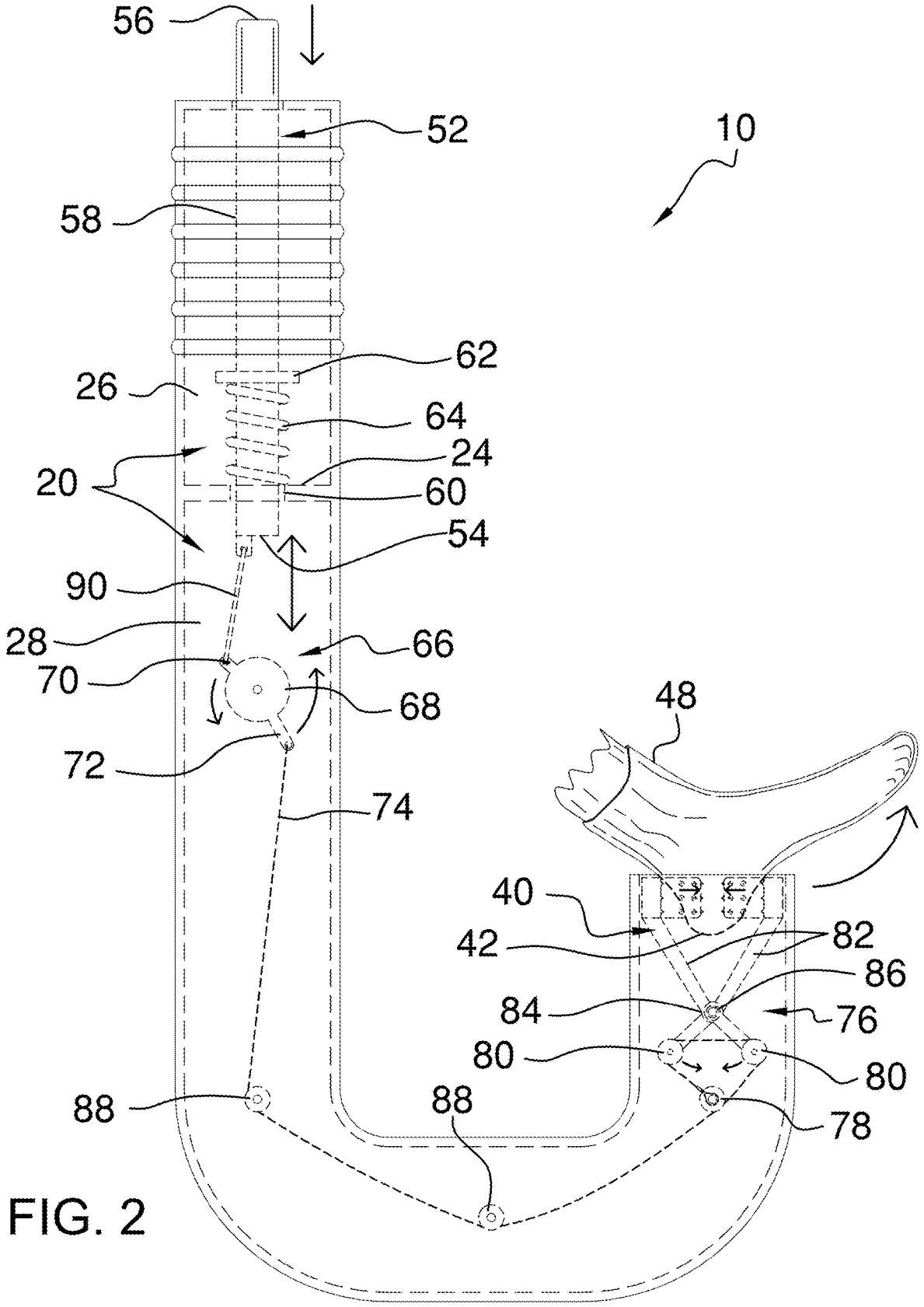
FIG. 2 is an in-use view of an embodiment of the disclosure.
Figure 3:
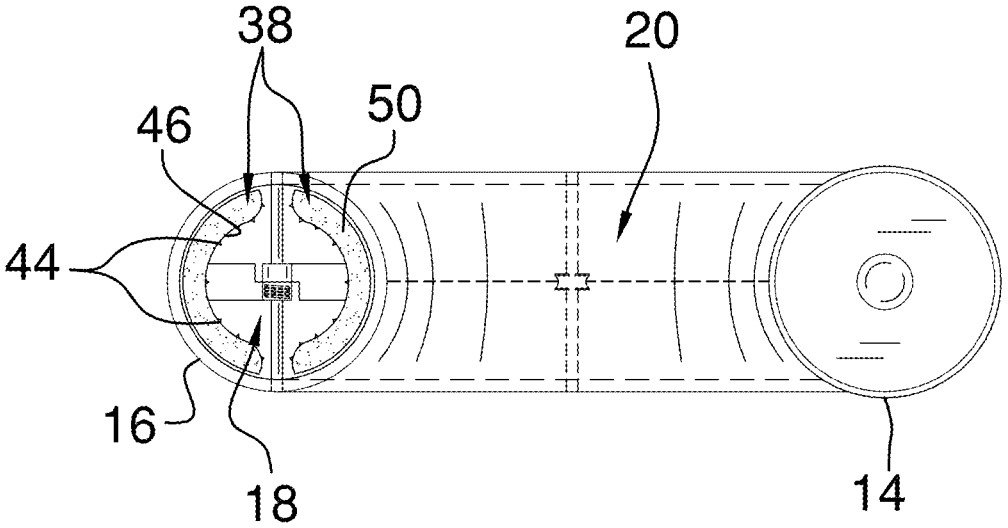
FIG. 3 is a top view of an embodiment of the disclosure.

With reference now to the drawings, and in particular to FIGS. 1 through 3 thereof, a new undressing aid embodying the principles and concepts of an embodiment of the disclosure and generally designated by the reference numeral 10 will be described.

As best illustrated in FIGS. 1 through 3, the sock removal device 10 generally comprises a heel hook 12 that has a first end 14 and a second end 16. The second end 16 defines an opening 18 extending into an interior space 20 of the heel hook 12. The heel hook 12 may include an elongated portion 22 extending from the first end 14. A partition 24 may be positioned within the elongated portion 22. The partition 24 is spaced from the first end 14 wherein the partition 24 separates the interior space 20 into a first chamber 26 and a second chamber 28. The first chamber 26 is positioned between the second chamber 28 and the first end 14 of the heel hook 12, and generally has a volume exceeding a volume of the second chamber 28.

A first curved portion 30 extends outwardly and downwardly from the elongated portion 22. A midsection 32 extends outwardly from the first curved portion 30. The midsection 32 may be perpendicular to the elongated portion 22. A second curved portion 34 extends upwardly from the midsection 32. A shortened portion 36 extends upwardly from the second curved portion 34. The shortened portion 36 may be parallel to the elongated portion 22. The shortened portion 36 has a length that is less than a length of the elongated portion 22.

A pair of contact members 38 are coupled to an inner surface 40 of the heel hook 12. The pair of contact members 38 are positioned adjacent to the second end 16 of the heel hook 12 wherein the pair of contact members 38 are exposed within the opening 18. The pair of contact members 38 are spaced from each other by a distance that is configured for being complementary to a size of a heel of a foot of a user wherein the pair of contact members 38 are configured for being positionable around the heel of the foot of the user. Thus, the pair of contact members 38 are positioned very close to the second end 16, allowing the user to position the foot on the second end 16 with the pair of contact members 38 in position to physically contact the heel.

Each contact member of the pair of contact members 38 includes a plurality of frictional elements 44 protruding from an outer surface 46 of each contact member of the pair of contact members 38 into the opening 18 wherein the plurality of frictional elements 44 are configured to physically contact a sock 48 on the foot of the user for gripping a heel portion 42 of the sock 48 between the pair of contact members 38. Examples of the plurality of frictional elements include, but are not limited to, rubber nubs or protrusions, foam fingers or pads, and silicone bristles or fins. Each contact member also includes a resiliently deformable material 50 configured for conforming a shape of each contact member of the pair of contact members 38 with the heel of the foot whereby the resiliently deformable material 50 is configured to facilitate the plurality of frictional elements 44 in gripping the sock 48 between the pair of contact members 38. Examples of the resiliently deformable material 50 include, but are not limited to, elastomers, foams, and gels.

An actuator 52 extends outwardly from the first end 14 of the heel hook 12. The actuator 52 is nested within the heel hook 12 wherein the actuator 52 is selectively movable upwardly and downwardly relative to the first end 14. A nested end 54 of the actuator 52 is positioned within the second chamber 28 of the interior space 20. An exposed end 56 is fully positioned outside of the heel hook 12. A shaft 58 extends between the nested end 54 and the exposed end 56. The shaft 58 is positioned to extend through an aperture 60 within the partition 24 wherein the shaft 58 is positioned in each of the first chamber 26 and the second chamber 28 of the interior space 20. The shaft 58 extending outwardly through the first end 14 of the heel hook 12 whereby the exposed end 56 is fully positioned outside of the heel hook 12.

A stop 62 is fixedly coupled to the shaft 58. The stop 62 has a size exceeding a size of the aperture 60 wherein the stop 62 inhibits a portion of the shaft 58 between the exposed end 56 and the stop 62 from extending into the second chamber 28 when the actuator 52 is moved downwardly toward the first end 14 of the heel hook 12. An actuator spring 64 is coupled to the stop 62. The actuator spring 64 is positioned around the shaft 58 between the partition 24 and the stop 62. When the actuator 52 is moved downwardly toward the first end 14, the actuator spring 64 is compressed. The actuator spring 64 is biased to expand wherein the actuator spring 64 urges the stop 62 away from the partition 24 to urge the exposed end 56 of the actuator 52 upwardly relative to the first end 14 of the heel hook 12 when the actuator 52 is released.

A primary pulley mechanism 66 is mechanically coupled to the actuator 52 wherein movement of the actuator 52 toward and away from the first end 14 actuates the primary pulley mechanism 66. A body 68 of the primary pulley mechanism 66 is pivotably coupled to the heel hook 12 within the elongated portion 22 wherein the body 68 is pivotable in a first direction and a second direction about a center point of the body 68. A first arm 70 extends outwardly from the body 68. The first arm 70 is mechanically coupled to the actuator 52 wherein the first arm 70 urges the body 68 to pivot in the first direction when the actuator 52 is moved downwardly and wherein the first arm 70 urges the body 68 to pivot in the second direction when the actuator 52 is moved upwardly. For example, the first direction may be counter-clockwise and the second direction may be clockwise.

A second arm 72 extends outwardly from the body 68. The second arm 72 is spaced from the first arm 70 wherein the second arm 72 is pivoted upwardly when the body 68 is pivoted in the first direction by the first arm 70 and wherein the second arm 72 is pivoted downwardly when the body 68 is pivoted in the second direction by the first arm 70. A tether 74 is coupled to and extends from the second arm 72 of the primary pulley mechanism 66. The tether 74 is fully positioned within the interior space 20 and is a flexible material.

A secondary pulley mechanism 76 is coupled to the tether 74 and to the pair of contact members 38. The primary pulley mechanism 66 actuates the secondary pulley mechanism 76 to selectively urge the pair of contact members 38 toward and away from each other when the actuator 52 is moved upwardly and downwardly relative to the first end 14 of the heel hook 12. A base wheel 78 of the secondary pulley mechanism 76 is positioned in the second chamber 28 f the interior space 20. The tether 74 is fixedly coupled to the base wheel 78.

A pair of upper wheels 80 are positioned between the base wheel 78 and the second end 16 of the heel hook 12. The base wheel 78 is generally centered between the pair of upper wheels 80. The tether 74 extends over the pair of upper wheels 80 to the base wheel 78. The pair of upper wheels 80 are movably positioned within the interior space 20 of the shortened portion 36 of the heel hook 12. The tether 74 urges the pair of upper wheels 80 toward each other when the actuator 52 is moved downwardly relative to the first end 14 of the heel hook 12.

A pair of legs 82 are coupled to the pair of upper wheels 80 and the pair of contact members 38. More specifically, each leg of the pair of legs 82 extends between a respective upper wheel of the pair of upper wheels 80 and an associated contact member of the pair of contact members 38. The pair of legs 82 intersect each other at a pivot point 84. The pair of legs 82 pivot toward each other about the pivot point 84 when the pair of upper wheels 80 pivot toward each other. Thus, the pair of legs 82 urge the pair of contact members 38 toward each other when the actuator 52 is moved downwardly relative to the first end 14 of the heel hook 12. By moving toward each other, the pair of contact members 38 are configured to grip the heel portion 42 of the sock 48 while the actuator 52 is moved downwardly relative to the first end 14 of the heel hook 12.

A leg spring 86 is mechanically coupled to the pair of legs 82. The leg spring 86 is positioned at the pivot point 84 and is compressed when the pair of legs 82 are pivoted toward each other. The leg spring 86 is biased to expand wherein the leg spring 86 urges the pair of legs 82 outwardly relative to each other when tension on the tether 74 is released. Tension on the tether 74 is released when the second arm 72 of the primary pulley mechanism 66 is pivoted downwardly because the actuator 52 is moved upwardly relative to the first end 14 of the heel hook 12.

A plurality of guides 88 are spaced from each other within the interior space 20 of the heel hook 12. The plurality of guides 88 are positioned between the primary pulley mechanism 66 and the secondary pulley mechanism 76. The tether 74 is engaged with each guide of the plurality of guides 88 wherein the plurality of guides 88 maintain a position of the tether 74 within the interior space 20 of the heel hook 12.

A dowel 90 couples the first arm 70 of the primary pulley mechanism 66 to the nested end 54 of the actuator 52. The dowel 90 is rigid to ensure the dowel 90 urges first arm 70 downwardly when the actuator 52 is urged downward and to ensure the dowel 90 urges the first arm 70 upwardly when the actuator 52 is urged upwardly. A grip 92 may be coupled to an exterior surface 94 of the heel hook 12. The grip 92 is positioned on the elongated portion 22 proximate to the first end 14 wherein the grip 92 is configured to facilitate the user in holding the elongated portion 22 while manipulating the actuator 52.

In use, a method for removing the sock 48 incudes providing the sock 48 removal device 10 and positioning the foot of the user adjacent to the heel hook 12 such that the heel portion 42 of the sock 48 is positioned between the pair of contact members 38 within the opening 18 defined by the second end 16 of the heel hook 12. The heel hook 12 can be held adjacent to the first end 14 wherein the actuator 52 is configured for being within reach of the user while the user is sitting upwardly relative to the foot.

The actuator 52 can be moved downwardly relative to the first end 14 of the heel hook 12 to urge the pair of contact members 38 toward each other around the heel portion 42 of the sock 48 for engaging the heel portion 42 of the sock 48. Then, the heel hook 12 can be pushed forwardly relative to the user to urge the heel portion 42 of the sock 48 forwardly toward a plurality of toes of the user. The sock 48 is removed by pulling the heel portion 42 of the sock 48 forwardly past the plurality of toes. The actuator 52 can be released, such that the actuator spring 64 expands to urge the actuator 52 upwardly and the leg spring 86 expands to urge the pair of contact members 38 away from each other to release the sock 48 from the heel hook 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sock removal assembly comprising:

a heel hook having a first end and a second end, said second end defining an opening extending into said heel hook;

a pair of contact members being positioned adjacent to said second end of said heel hook wherein said pair of contact members are exposed within said opening, said pair of contact members being spaced from each other by a distance configured for being complementary to a size of a heel of a foot of a user wherein said pair of contact members are configured for being positionable around said heel of said foot of said user, each contact member of said pair of contact members including:

a plurality of frictional elements configured to physically contact a sock on said foot of said user for gripping said sock between said pair of contact members to facilitate said user in removing said sock from said foot;

an actuator being nested within said heel hook wherein said actuator is selectively movable downwardly relative to said first end;

a primary pulley mechanism being mechanically engaged with said actuator wherein movement of said actuator downwardly relative to said first end actuates said primary pulley mechanism; and a secondary pulley mechanism being mechanically engaged with said primary pulley mechanism and said pair of contact members wherein said primary pulley mechanism actuates said secondary pulley mechanism to selectively urge said pair of contact members toward each other when said actuator is moved downwardly relative to said first end of said heel hook.

2. The sock removal assembly of claim 1, further comprising:

a tether being coupled to and extending from said primary pulley mechanism, said secondary pulley mechanism being coupled to said tether; and a plurality of guides being positioned between said primary pulley mechanism and said secondary pulley mechanism, said tether being engaged with each guide of said plurality of guides wherein said plurality of guides maintain a position of said tether within said heel hook.

3. The sock removal assembly of claim 2, wherein said tether is fully positioned within said heel hook.

4. The sock removal assembly of claim 2, wherein said tether includes a flexible material.

5. The sock removal assembly of claim 1, wherein said plurality of frictional elements protrude from an outer surface of each contact member of said pair of contact members into said opening.

6. The sock removal assembly of claim 1, said heel hook further comprising:

an interior space, said opening extending into said interior space;

an elongated portion extending from said first end; and a partition being positioned within said elongated portion, said partition being spaced from said first end wherein said partition separates said interior space into a first chamber and a second chamber, said first chamber being positioned between said second chamber and said first end of said heel hook.

7. The sock removal assembly of claim 6, said actuator further comprising:

a nested end being positioned within said interior space;

an exposed end being fully positioned outside of said heel hook;

a shaft extending between said nested end and said exposed end, said shaft being positioned to extend through an aperture within said partition wherein said shaft is positioned in each of said first chamber and said second chamber of said interior space;

a stop being fixedly coupled to said shaft, said stop having a size exceeding a size of said aperture wherein said stop inhibits a portion of said shaft between said exposed end and said stop from extending into said second chamber when said actuator is moved downwardly toward said first end of said heel hook; and an actuator spring being coupled to said stop, said actuator spring being positioned around said shaft between said partition and said stop, said actuator spring being compressed when said actuator is moved downwardly toward said first end, said actuator spring being biased to expand wherein said actuator spring urges said stop away from said partition to urge said exposed end of said actuator upwardly relative to said first end of said heel hook when said actuator is released.

8. The sock removal assembly of claim 6, said heel hook further comprising:

a first curved portion extending outwardly and downwardly from said elongated portion;

a midsection extending outwardly from said first curved portion;

a second curved portion extending upwardly from said midsection; and a shortened portion extending upwardly from said second curved portion.

9. The sock removal assembly of claim 1, each contact member of said pair of contact members further comprising a resiliently deformable material configured for conforming a shape of each contact member of said pair of contact members with said heel of said foot whereby said resiliently deformable material is configured to facilitate said plurality of frictional elements in gripping said sock between said pair of contact members.

10. The sock removal assembly of claim 1, said primary pulley mechanism further comprising:

a body being pivotably coupled to said heel hook wherein said body is pivotable about a center point of said body;

a first arm extending outwardly from said body, said first arm being mechanically coupled to said actuator wherein said first arm urges said body to pivot in a first direction when said actuator is moved downwardly; and a second arm extending outwardly from said body, said second arm being spaced from said first arm wherein said second arm is pivoted upwardly when said body is pivoted in said first direction.

11. The sock removal assembly of claim 10, further comprising a dowel coupling said first arm of said primary pulley mechanism to said nested end of said actuator, said dowel being rigid.

12. The sock removal assembly of claim 1, further comprising:

a tether coupling said primary pulley mechanism to said secondary pulley mechanism, said secondary pulley mechanism including:

a base wheel, said tether being fixedly coupled to said base wheel;

a pair of upper wheels being positioned between said base wheel and said second end of said heel hook, said tether extending over said pair of upper wheels to said base wheel, said pair of upper wheels being movably positioned within said heel hook, said tether urging said pair of upper wheels toward each other when said actuator is moved downwardly relative to said first end of said heel hook;

a pair of legs being coupled to said pair of upper wheels and said pair of contact members wherein each leg of said pair of legs extends between a respective upper wheel of said pair of upper wheels and an associated contact member of said pair of contact members, said pair of legs pivoting toward each other when said pair of upper wheels pivot toward each other wherein said pair of legs urge said pair of contact members toward each other.

13. The sock removal assembly of claim 12, wherein said pair of legs intersect each other at a pivot point.

14. The sock removal assembly of claim 13, said secondary pulley mechanism further comprising a leg spring being mechanically coupled to said pair of legs, said leg spring being positioned at said pivot point, said leg spring being compressed when said pair of legs are pivoted toward each other, said leg spring being biased to expand wherein said leg spring urges said pair of legs outwardly relative to each other when tension on said tether is released by said second arm of said primary pulley mechanism being pivoted downwardly when said actuator is moved upwardly relative to said first end of said heel hook.

15. A sock removal assembly comprising:

a heel hook having a first end and a second end, said second end defining an opening extending into an interior space of said heel hook, said heel hook including:

an elongated portion extending from said first end:

a partition being positioned within said elongated portion, said partition being spaced from said first end wherein said partition separates said interior space into a first chamber and a second chamber, said first chamber being positioned between said second chamber and said first end of said heel hook;

a first curved portion extending outwardly and downwardly from said elongated portion;

a midsection extending outwardly from said first curved portion, said midsection being perpendicular to said elongated section;

a second curved portion extending upwardly from said midsection; and a shortened portion extending upwardly from said second curved portion, said shortened portion being parallel to said elongated portion, said shortened portion having a length being less than a length of said elongated portion;

a pair of contact members being coupled to an inner surface of said heel hook, said pair of contact members being positioned adjacent to said second end of said heel hook wherein said pair of contact members are exposed within said opening, said pair of contact members being spaced from each other by a distance configured for being complementary to a size of a heel of a foot of a user wherein said pair of contact members are configured for being positionable around said heel of said foot of said user, each contact member of said pair of contact members including:

a plurality of frictional elements protruding from an outer surface of each contact member of said pair of contact members into said opening wherein said plurality of frictional elements are configured to physically contact a sock on said foot of said user for gripping said sock between said pair of contact members; and a resiliently deformable material configured for conforming a shape of each contact member of said pair of contact members with said heel of said foot whereby said resiliently deformable material is configured to facilitate said plurality of frictional elements in gripping said sock between said pair of contact members;

an actuator extending outwardly from said first end of said heel hook, said actuator being nested within said heel hook wherein said actuator is selectively movable upwardly and downwardly relative to said first end, said actuator including:

a nested end being positioned within said second chamber of said interior space;

an exposed end being fully positioned outside of said heel hook;

a shaft extending between said nested end and said exposed end, said shaft being positioned to extend through an aperture within said partition wherein said shaft is positioned in each of said first chamber and said second chamber of said interior space, said shaft extending outwardly through said first end of said heel hook whereby said exposed end is fully positioned outside of said heel hook;

a stop being fixedly coupled to said shaft, said stop having a size exceeding a size of said aperture wherein said stop inhibits a portion of said shaft between said exposed end and said stop from extending into said second chamber when said actuator is moved downwardly toward said first end of said heel hook; and an actuator spring being coupled to said stop, said actuator spring being positioned around said shaft between said partition and said stop, said actuator spring being compressed when said actuator is moved downwardly toward said first end, said actuator spring being biased to expand wherein said actuator spring urges said stop away from said partition to urge said exposed end of said actuator upwardly relative to said first end of said heel hook when said actuator is released;

a primary pulley mechanism being mechanically coupled to said actuator wherein movement of said actuator toward and away from said first end actuates said primary pulley mechanism, said primary pulley mechanism including:

a body being pivotably coupled to said heel hook within said elongated portion wherein said body is pivotable in a first direction and a second direction about a center point of said body;

a first arm extending outwardly from said body, said first arm being mechanically coupled to said actuator wherein said first arm urges said body to pivot in said first direction when said actuator is moved downwardly and wherein said first arm urges said body to pivot in said second direction when said actuator is moved upwardly, said first direction being counterclockwise, said second direction being clockwise; and a second arm extending outwardly from said body, said second arm being spaced from said first arm wherein said second arm is pivoted upwardly when said body is pivoted in said first direction by said first arm and wherein said second arm is pivoted downwardly when said body is pivoted in said second direction by said first arm;

a tether being coupled to and extending from said second arm of said primary pulley mechanism, said tether being fully positioned within said interior space, said tether being a flexible material;

a secondary pulley mechanism being coupled to said tether and to said pair of contact members wherein said primary pulley mechanism actuates said secondary pulley mechanism to selectively urge said pair of contact members toward and away from each other when said actuator is moved upwardly and downwardly relative to said first end of said heel hook, said secondary pulley mechanism including:

a base wheel, said tether being fixedly coupled to said base wheel;

a pair of upper wheels being positioned between said base wheel and said second end of said heel hook, said base wheel being centered between said pair of upper wheels, said tether extending over said pair of upper wheels to said base wheel, said pair of tethers being movably positioned within said interior space of said shortened portion of said heel hook, said tether urging said pair of upper wheels toward each other when said actuator is moved downwardly relative to said first end of said heel hook;

a pair of legs being coupled to said pair of upper wheels and said pair of contact members wherein each leg of said pair of legs extends between a respective upper wheel of said pair of upper wheels and an associated contact member of said pair of contact members, said pair of legs intersecting each other at a pivot point, said pair of legs pivoting toward each other when said pair of upper wheels pivot toward each other wherein said pair of legs urge said pair of contact members toward each other when said actuator is moved downwardly relative to said first end of said heel hook whereby said pair of contact members are configured to grip said sock while said actuator is moved downwardly relative to said first end of said heel hook; and a leg spring being mechanically coupled to said pair of legs, said leg spring being positioned at said pivot point, said leg spring being compressed when said pair of legs are pivoted toward each other, said leg spring being biased to expand wherein said leg spring urges said pair of legs outwardly relative to each other when tension on said tether is released by said second arm of said primary pulley mechanism being pivoted downwardly when said actuator is moved upwardly relative to said first end of said heel hook;

a plurality of guides being spaced from each other within said interior space of said heel hook, said plurality of guides being positioned between said primary pulley mechanism and said secondary pulley mechanism, said tether being engaged with each guide of said plurality of guides wherein said plurality of guides maintain a position of said tether within said interior space of said heel hook; and a dowel coupling said first arm of said primary pulley mechanism to said exposed end of said actuator, said dowel being rigid.

16. A method for removing a sock comprising:

providing a sock removal assembly including:

a heel hook having a first end and a second end, said second end defining an opening extending into said heel hook;

a pair of contact members being positioned adjacent to said second end of said heel hook wherein said pair of contact members are exposed within said opening, said pair of contact members being spaced from each other by a distance configured for being complementary to a size of said heel of a foot of a user wherein said pair of contact members are configured for being positionable around said heel of said foot of said user, each contact member of said pair of contact members including:

a plurality of frictional elements protruding from an outer surface of each contact member of said pair of contact members into said opening wherein said plurality of frictional elements are configured to physically contact said heel portion of said sock on said foot of said user for gripping said heel portion of said sock between said pair of contact members to facilitate said user in removing said sock from said foot;

an actuator extending outwardly from said first end of said heel hook, said actuator being nested within said heel hook wherein said actuator is selectively movable downwardly relative to said first end;

a primary pulley mechanism being mechanically engaged with said actuator wherein movement of said actuator downwardly relative to said first end actuates said primary pulley mechanism; and a secondary pulley mechanism being mechanically engaged with said primary pulley mechanism and said pair of contact members wherein said primary pulley mechanism actuates said secondary pulley mechanism to selectively urge said pair of contact members toward each other when said actuator is moved downwardly relative to said first end of said heel hook;

positioning said foot of said user adjacent to said heel hook such that said heel portion of said sock is positioned between said pair of contact members within said opening defined by said second end of said heel hook;

holding said heel hook adjacent to said first end wherein said actuator is configured for being within reach of said user while said user is sitting upwardly relative to said foot;

moving said actuator downwardly relative to said first end of said heel hook to urge said pair of contact members toward each other around said heel portion of said sock for engaging said heel portion of said sock;

pushing said heel hook forwardly relative to said user to urge said heel portion of said sock forwardly toward a plurality of toes of said user; and removing said sock by pulling said heel portion of said sock forwardly past said plurality of toes.

* * * * *